US011957957B2

(12) United States Patent
Van Dyke

(10) Patent No.: US 11,957,957 B2
(45) Date of Patent: Apr. 16, 2024

(54) PIVOTING BOARD EXERCISE DEVICE

(71) Applicant: Perform Stoic LLC, Torrance, CA (US)

(72) Inventor: Justin Van Dyke, Torrance, CA (US)

(73) Assignee: Perform Stoic LLC, Torrance, CA (US)

( * ) Notice: Subject to any disclaimer, the term of this patent is extended or adjusted under 35 U.S.C. 154(b) by 72 days.

(21) Appl. No.: 17/515,740

(22) Filed: Nov. 1, 2021

(65) Prior Publication Data

US 2023/0139865 A1 May 4, 2023

(51) Int. Cl.
*A63B 22/18* (2006.01)
*A63B 21/04* (2006.01)

(52) U.S. Cl.
CPC ..... *A63B 22/18* (2013.01); *A63B 21/0435* (2013.01); *A63B 2225/055* (2013.01)

(58) Field of Classification Search
CPC ..... A63B 22/18; A63B 22/14; A63B 22/20; A63B 21/0428; A63B 21/0089; A63B 21/0552; A63B 21/02; A63B 21/045–0455; A63B 21/22; A63B 21/222; A63B 21/4033–4035; A63B 21/4047–4049; A63B 2209/00; A63B 2225/055; A63B 23/0216; A63B 23/0222; A63B 23/1236; A63B 23/08; A63B 23/085; A63B 2210/50; A63B 26/00–003; A63B 2026/006
USPC ..... 482/146, 147
See application file for complete search history.

(56) References Cited

U.S. PATENT DOCUMENTS

| | | | |
|---|---|---|---|
| 1,533,500 | A | 4/1925 | Hovda |
| 3,512,774 | A | 5/1970 | Honer |
| 3,593,994 | A | 7/1971 | Anbar |
| 4,132,405 | A | 1/1979 | Asher |
| 4,787,630 | A | 11/1988 | Watson et al. |
| 4,953,858 | A | 9/1990 | Zelli |

(Continued)

FOREIGN PATENT DOCUMENTS

| | | | |
|---|---|---|---|
| GB | 2407046 | A | 4/2005 |
| KR | 102191719 | B1 | 12/2020 |

OTHER PUBLICATIONS https://www.google.com/search?q=perfect+pushup&client=safari&hl=en-us&prmd=vsin&source=Inms&tbm=isch&sa=X&ved=2ahUKEwin2Lub4JXoAhUFvJ4KHcCGBq4Q_AUoA30ECA4QAw#imgrc=h6EqScYu0y656M (Retrieved Oct. 21, 2021).

(Continued)

*Primary Examiner* — Megan Anderson
*Assistant Examiner* — Kathleen M Fisk
(74) *Attorney, Agent, or Firm* — Optima Law Group, APC; Thomas E. Jurgensen

(57) ABSTRACT

A pivot board exercise device has a top circular part that may rotate in relation to a bottom circular part, and a unique unibody or complex multi-arm resistance mechanism is secured at its center to a rotational center platform of the top circular part, and is secured at the end of each arm to posts projecting from the bottom circular part. The unibody multi-arm resistance mechanism is a single piece of resilient/flexible material, the complex multi-arm resistance mechanism has multiple arms attached at the ends to the bottom part, so when the top of the invention is rotated relative to the bottom, resistance is offered, the resistance increasing with rotation and occurring regardless of the direction of rotation.

5 Claims, 14 Drawing Sheets

(56) References Cited

U.S. PATENT DOCUMENTS

| | | | | |
|---|---|---|---|---|
| 5,147,265 | A | 9/1992 | Pauls et al. | |
| 5,683,337 | A | 11/1997 | Zetocha et al. | |
| 7,625,323 | B1 * | 12/2009 | Lin | A63B 22/0087 482/146 |
| 8,529,416 | B2 | 9/2013 | Jennings | |
| 8,771,157 | B2 | 7/2014 | Caponigro | |
| 8,986,180 | B1 * | 3/2015 | VanBuren | A63B 26/003 482/145 |
| 9,295,873 | B1 | 3/2016 | Lacaze | |
| 9,968,820 | B2 | 5/2018 | Stockhausen | |
| 10,343,006 | B2 * | 7/2019 | Francis | A63B 21/045 |
| 10,449,405 | B2 | 10/2019 | Endelman et al. | |
| 2003/0032533 | A1 * | 2/2003 | Hecox | A63B 22/18 482/130 |
| 2003/0181300 | A1 * | 9/2003 | Chin | A63B 22/14 482/146 |
| 2005/0148450 | A1 * | 7/2005 | Huang | A63B 71/0622 482/146 |
| 2006/0046901 | A1 | 3/2006 | Pan et al. | |
| 2007/0298945 | A1 * | 12/2007 | Mehta | A63B 22/14 482/130 |
| 2009/0054218 | A1 * | 2/2009 | Tsai | A63B 22/14 482/147 |
| 2012/0225741 | A1 | 9/2012 | Antolick | |
| 2013/0023391 | A1 | 1/2013 | Nicholas | |
| 2014/0155236 | A1 | 6/2014 | Curry | |
| 2016/0263424 | A1 * | 9/2016 | LaCaze | A63B 21/068 |
| 2017/0368401 | A1 | 12/2017 | Francis et al. | |
| 2018/0117384 | A1 | 5/2018 | Endelman et al. | |

OTHER PUBLICATIONS https://www.merrithew.com/shop/ProductDetail/ST06002_Rotational-Disk--12-Inch-pair?Currency=USD&gclid=EAIaIQobChMII-SIpOGV6AIVjxitBh1QLgp8EAkYASABEgJtMfD_BwE (Retrieved Oct. 21, 2021).

* cited by examiner

PIVOTING BOARD EXERCISE DEVICE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but reserves all copyright rights whatsoever. 37 CFR 1.71(d).

CROSS-REFERENCE TO RELATED APPLICATIONS

N/A

Inventor

Justin Van Dyke

FIELD OF THE INVENTION

This invention relates generally to exercise devices and specifically to devices for resistance training in rotational limb and body motion, more specifically, devices with a low profile and usable shape allowing numerous types of exercise.

STATEMENT REGARDING FEDERALLY FUNDED RESEARCH

This invention was not made under contract with an agency of the US Government, nor by any agency of the US Government.

BACKGROUND OF THE INVENTION

Rotational motions in exercise are of high importance for certain muscle groups, care of tendons and connective tissues and the overall flexibility of the individual. However, most rotational exercises are inherently dependent only upon the motion of the individual. That is, for strength and flexibility conditioning, it is accepted that adaptive resistance is one excellent method of developing and maintaining health. However, there is very little resistance-based training methods and there is also a very small number of resistance-based training devices, in the realm of rotational exercise.

A disk-shaped device has inherent advantages for this. Such shapes may be used with hands, feet, joints, large limbs, horizontally on a floor or vertically on a wall and in conjunction with numerous motions.

Some examples are included in the attached information disclosure statement. It will be seen that there are very few of the type presented herein: disk shaped devices allowing an individual to exert significant strength, or apply significant weight, to the device. In fact, the devices shown all tend to be similar in lacking structures for supporting a heavy load and yet allowing rotational motion against resistance.

It would be preferable to provide a rotational disk exercise device which offers not only a disk shape, increasing torsional resistance and ease of use, but also the ability to withstand significant imposed loads and many cycles of usage without suffering mechanical failure.

It would further be preferable to provide a rotational disk exercise device which offers a multiplicity of resistance elements, thereby increasing life of the resistance bands and thus durability of the device.

It would further be preferable to provide a rotational disk exercise device which offers support between the halves of the rotating disk sufficient to withstand numerous rotations and users imposing a great deal of weight.

SUMMARY OF THE INVENTION

General Summary

The present invention teaches a pivot board exercise device in which the top circular part may rotate in relation to the bottom circular part, but a unique unibody multi-arm resistance mechanism or a complex multi-arm resistance mechanism (having a central carousel from which the arms project) is secured at its center (a center interface aperture) to a rotational center platform of the top circular part, and is secured at the end of each arm to posts projecting from the bottom circular part. The unibody multi-arm resistance mechanism is a single piece of resilient (flexible, springy, etc.) material, the complex mechanism has resistance material arms, so that in either embodiment when the top of the invention is rotated relative to the bottom, resistance is offered, the resistance increasing with rotation and occurring regardless of the direction of rotation.

A base or back may have optional or removable suction cups to increase its hold on the floor or wall surface to which the device is placed.

The top surface may have a slightly padded gripping surface such as Neoprene brand polymer to offer a better grip to the user s hand, foot, limb, joint, body, etc.

A circular channel and rail serve as a toroidal bearing/roller race and toroidal ring bearing to provide greater stability and ease of rotation both.

Summary in Reference to Claims

It is therefore another aspect, advantage, objective and embodiment of the invention, in addition to those discussed previously, to provide an exercise device comprising:

- a circular body top and a circular body bottom, the circular body bottom having a plurality of posts projecting upward, the circular body top having a rotational center platform projecting downward;
- a non-slip base, the non-slip base disposed beneath the circular body bottom;
- a back, the back disposed beneath the non-slip base;
- a unibody multi-arm resistance mechanism, the unibody multi-arm resistance mechanism having a plurality of arms projecting from about a center interface aperture through a center of the unibody multi-arm resistance mechanism, each arm having at least one aperture, each aperture dimensioned and configured to accept one respective post of the plurality of posts, whereby the plurality of arms are secured to the circular body bottom;
- the unibody multi-arm resistance mechanism being a single unibody construction and made of a resilient material;
- the center interface aperture dimensioned and configured to mechanically engage to the rotational center platform, whereby the unibody multi-arm resistance mechanism is secured to the circular body top;
- a center post projecting upward from a center of the non-slip base through a first aperture in a center of the non-slip base, and through the circular body bottom through a second aperture in a center of the circular body bottom, and through the center interface aperture in the center of the unibody multi-arm resistance mechanism, and through a third aperture in a center of the rotational center platform of the circular body top;

the center post secured to an assembly retention nut atop the circular body top, whereby the entire assembly is secured together, and further whereby the circular body top may rotate in relation to the circular body bottom, but is urged against rotation due to the resistance offered by the multiple arms of the unibody multi-arm resistance mechanism.

It is therefore yet another aspect, advantage, objective and embodiment of the invention, in addition to those discussed previously, to provide an exercise device further comprising:

a neoprene top panel sitting atop the circular body top and the assembly retention nut.

It is therefore another aspect, advantage, objective and embodiment of the invention, in addition to those discussed previously, to provide an exercise device further comprising:

a channel about a circumference of the circular body bottom and a rail about a circumference of the circular body top, the rail and channel dimensioned and configured to mechanically engage so that the rail may ride in the channel with the channel serving as a race and the rail serving as a single toroidal bearing.

It is therefore another advantage, aspect, objective and embodiment of the invention, in addition to those discussed previously, to provide an exercise device further comprising:

a plurality of suction cups disposed upon a bottom of the back.

It is therefore another aspect, advantage, objective and embodiment of the invention, in addition to those discussed previously, to provide an exercise device comprising:

a circular body top and a circular body bottom, the circular body bottom having a plurality of posts projecting upward, the circular body top having a rotational center platform projecting downward;

a non-slip base, the non-slip base disposed beneath the circular body bottom;

a back, the back disposed beneath the non-slip base;

a multi-arm resistance mechanism, the multi-arm resistance mechanism having a central carousel, the central carousel having a center interface aperture, the multi-arm resistance mechanism having a plurality of arms projecting from the center carousel, each arm having at least one arm end bracket, each arm end bracket dimensioned and configured to accept at least one post of the plurality of posts, whereby the plurality of arms are secured to the circular body bottom;

the arms made of a resilient material;

the center interface aperture dimensioned and configured to mechanically engage to the rotational center platform, whereby the multi-arm resistance mechanism is secured to the circular body top;

a center post projecting upward from a center of the non-slip base through the center interface aperture in the center of the unibody multi-arm resistance mechanism, and into a center of the rotational center platform of the circular body top;

whereby the entire assembly is secured together, and further whereby the circular body top may rotate in relation to the circular body bottom, but is urged against rotation due to the resistance offered by the multiple arms of the unibody multi-arm resistance mechanism.

It is therefore another aspect, advantage, objective and embodiment of the invention, in addition to those discussed previously, to provide an exercise device further comprising:

a neoprene top panel sitting atop the circular body top.

It is therefore another advantage, objective, aspect and embodiment of the invention, in addition to those discussed previously and below, to provide an exercise device even yet further comprising: a bearing race in the circular body bottom dimensioned and configured to accept at least one bearing and to mechanically engage thereto, so that the at least one bearing may ride in the roller race.

It is therefore another aspect, advantage, objective and embodiment of the invention, in addition to those discussed previously, to provide an exercise device even yet further comprising:

a roller race about a circumference of the circular body bottom dimensioned and configured to mechanically engage to a plurality of rollers attached to the circular body top, so that the rollers may ride in the roller race.

INDEX TO REFERENCE NUMERALS

First Embodiment

Pivot board 100

Figure 1:
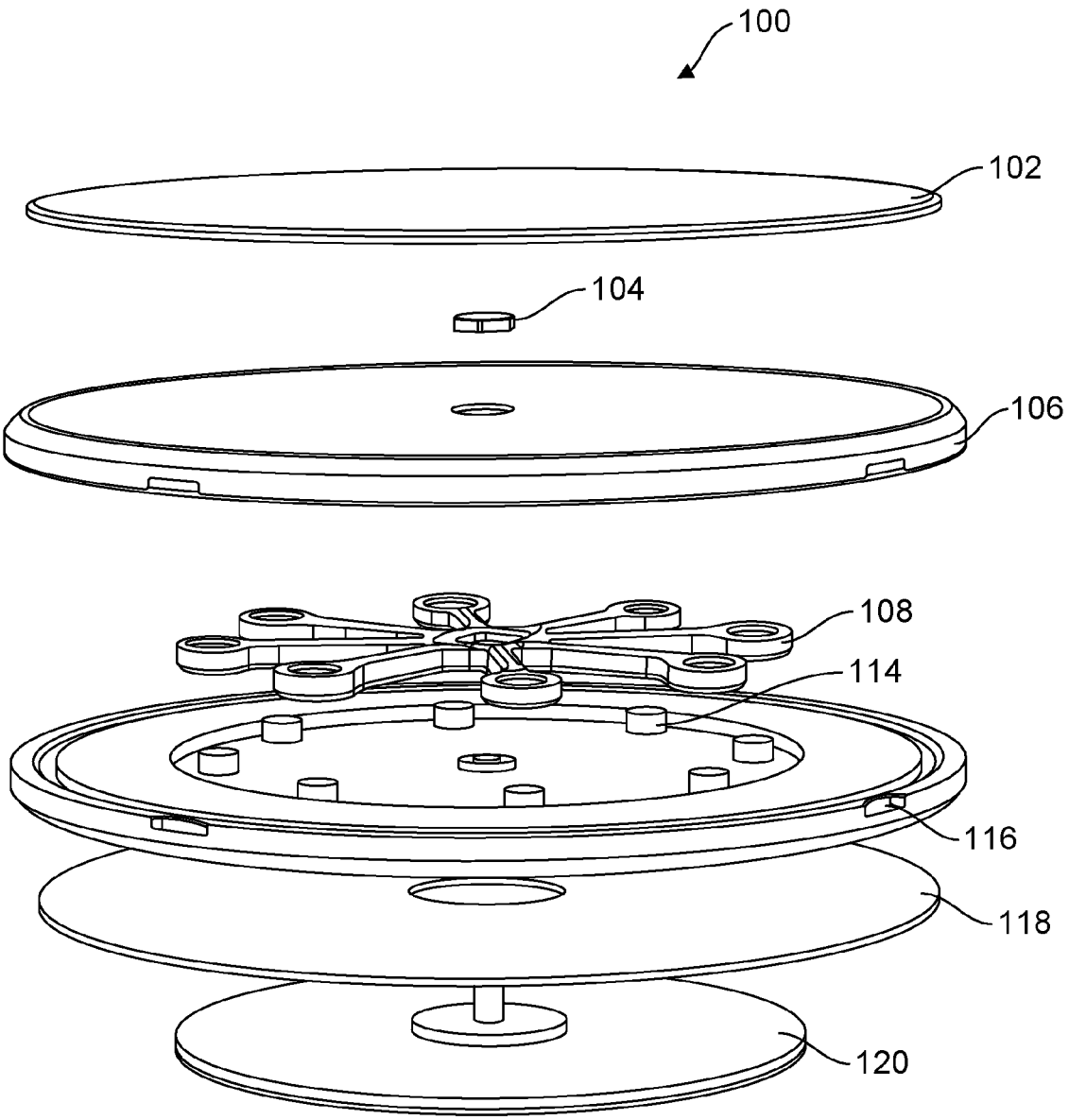
FIG. 1 is an overview exploded front slightly elevational view of a first embodiment of the invention showing most of the major components.

Neoprene top pad 102
Assembly retention nut 104
Main body top 106
Unibody multiarm resistance mechanism 108
Center interface aperture 109
Arm 110
Aperture 112
Mounting posts 114
Main body bottom 116
Rubber non-slip base 118
Wall base/back 120
Rotational center post 122
Suction cup 124
Channel 126
Rail 128
Rotational center platform 130
Divot 132
Rotational degrees of freedom 134
Second Embodiment:
Pivot board 200
Neoprene top pad 202
Main body top 206
Multi arm resistance mechanism 208
Center interface aperture 209
Arm 210
Carousel 211
Arm aperture 212
Mounting posts 214
Arm end bracket 215
Main body bottom 216
Rubber non-slip base 218
Rotational center post 222
Suction cup 224
Channel 236
Roller race 238
Roller 240

DETAILED DESCRIPTION

Glossary

As used herein the term resilient means anything which may be elastically deformed, in particular, stretched, but then returns to normal shape when torsion is released, and which offers resistance to being twisted/torqued/stretched.

The term unibody means a body which is not composed of sub-parts, but which is rather cast, molded or otherwise manufactured in a single piece and thus has advantageous properties of strength and durability in comparison to multiple smaller bodies or sub-components.

End Glossary

FIG. 1 is an overview exploded front slightly elevational view of a first embodiment of the invention showing most of the major components.

Pivot board 100 has a number of layered components, however, these components may or may not be tightly secured to the layers above or below them.

Neoprene top pad 102 may be a slightly padded and high friction gripping surface such as Neoprene brand polymer to offer a better grip to the user s hand, foot, limb, joint, body, etc. This is the part the user will apply their hand, etc. to when using the device.

Assembly retention nut 104 is concealed beneath the top pad 102 sitting in a depression in the top surface of the main body top 106. This depression is found to be projecting downward into another part discussed in relation to FIG. 4 (see the rotational center platform 130).

Unibody multiarm resistance mechanism 108 distributes torsion from a user rotating the circular body top 106: the torsion flows smoothly into multiple arms. In systems in which there are limited numbers of elastic bands, the bands not only wear quickly and stretch even more quickly, the strain is not symmetrical and the user s body unconsciously learns little motions and methods to cheat their exercise regime.

Mounting posts 114 provide a stable connection from the arms to the main body bottom 116. These posts are not too near the periphery or circumference of the device but they are peripheral compared to the central interface aperture which secures 108 to the top body 106.

It will be noticed that the posts 114 and the unibody multiarm resistance mechanism 108 sit snugly within a shallow space or depression in the bottom body 116 and the top body 106. This allows the two halves of the device (top and bottom) to sit in greater proximity, increasing stability and decreasing weight and height.

Rubber non-slip base 118 sits on the bottom surface of the circular bottom body 116, and wall base/back 120 then sits beneath that. The back 120 is the final bottom of the device, though on its bottom optional suction cups (discussed further in relation to FIG. 6) may be employed.

Figure 2:
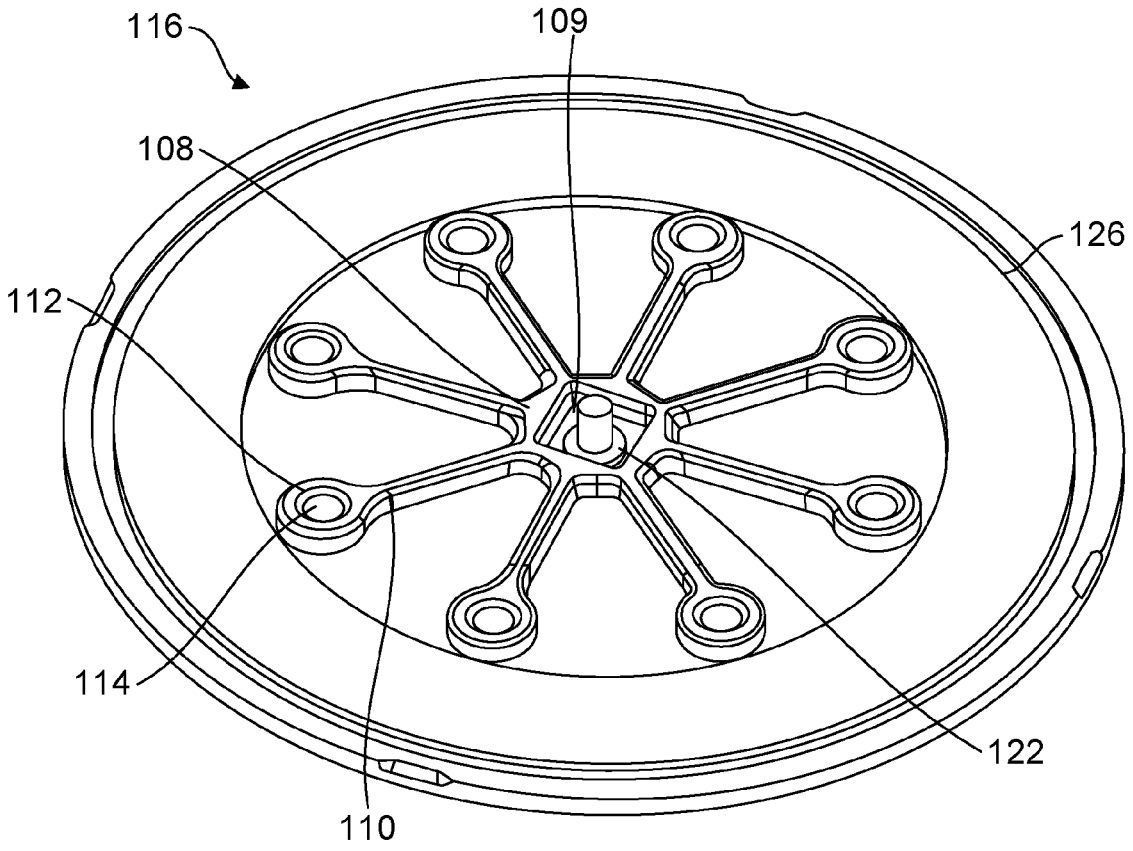
FIG. 2 is an elevation view of the bottom half of the body and bottom half of the overall assembly of the first embodiment of the invention, showing important details of the unibody multiarm resistance mechanism.

FIG. 2 is an elevation view of the bottom half of the body and bottom half of the overall assembly of the invention, showing important details of the unibody multiarm resistance mechanism.

Again, it may be seen that the unibody multiarm resistance mechanism 108 sits within a shallow depression in the circular bottom body 116. The unibody multiarm resistance mechanism 108 has a center interface aperture 109. This aperture (generally square in the preferred embodiment and best mode presently contemplated, but other shapes in other embodiments) will engage to a matching platform (also square in this embodiment) which is discussed in relation to FIG. 4.

Arm 110 has aperture 112 which may be located near the end of the arm (as shown) or more centrally, etc. The arm 110 need not be straight (as shown in this embodiment) but may be other shapes, other cross-sections, etc.

Mounting posts 114 project upward from the shallow depression in the circular bottom body 116 and into the apertures 112, thus securing the arms to the circular body bottom 116 but the center of the unibody multiarm resistance mechanism 108 to the circular body top 106 (be means of center interface aperture 109).

Main body bottom (aka circular body bottom) 116 has projecting through it from below the rotational center post 122. This post may or may not rotate itself but permits rotation of the circular top body and circular bottom body in relation to one another while fastening the layers of the invention together securely in cooperation with assembly retention nut 104.

Channel 126 passes about the periphery or circumference of circular bottom body 116 and serves as a bearing race with rail 128 riding in it as the bearing. In this embodiment, rail 128 acts as a single toroidal bearing. In other embodiments, multiple bearings may be used, multiple rollers may be used, etc.

Figure 3:
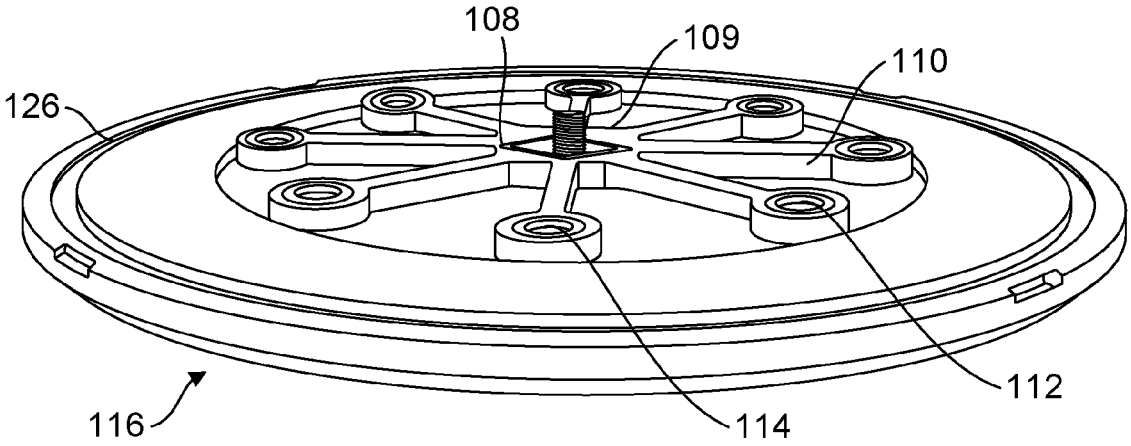
FIG. 3 is a front slightly elevational view of the bottom half of the body and bottom half of the first embodiment of the invention, showing details of the unibody multiarm resistance mechanism.

FIG. 3 is a front slightly elevational view of the bottom half of the body and bottom half of the overall invention, showing details of the unibody multiarm resistance mechanism 108. Center interface aperture 109 may be seen in the center of the unibody multiarm resistance mechanism 108.

Arm 110 having aperture 112 may once again be seen secured to mounting posts 114. In this particular embodiment, the best mode presently contemplated and the presently preferred embodiment (but not the only embodiment), the unibody multiarm resistance mechanism 108 has eight arms and in this embodiment the arms are equiradially spaced about the center of the unibody multiarm resistance mechanism 108. Obviously in alternative embodiments the unibody multiarm resistance mechanism 108 may have other numbers of arms, even or odd numbers, and the arms need not be exactly identical to all other arms. For example, one arrangement might be having four long arms and four short arms, with the eight posts disposed with four at one distance from the center of the unibody multiarm resistance mechanism 108 and four more at a second distance.

Main body bottom 116 is once again seen to have channel 126.

Figure 4:
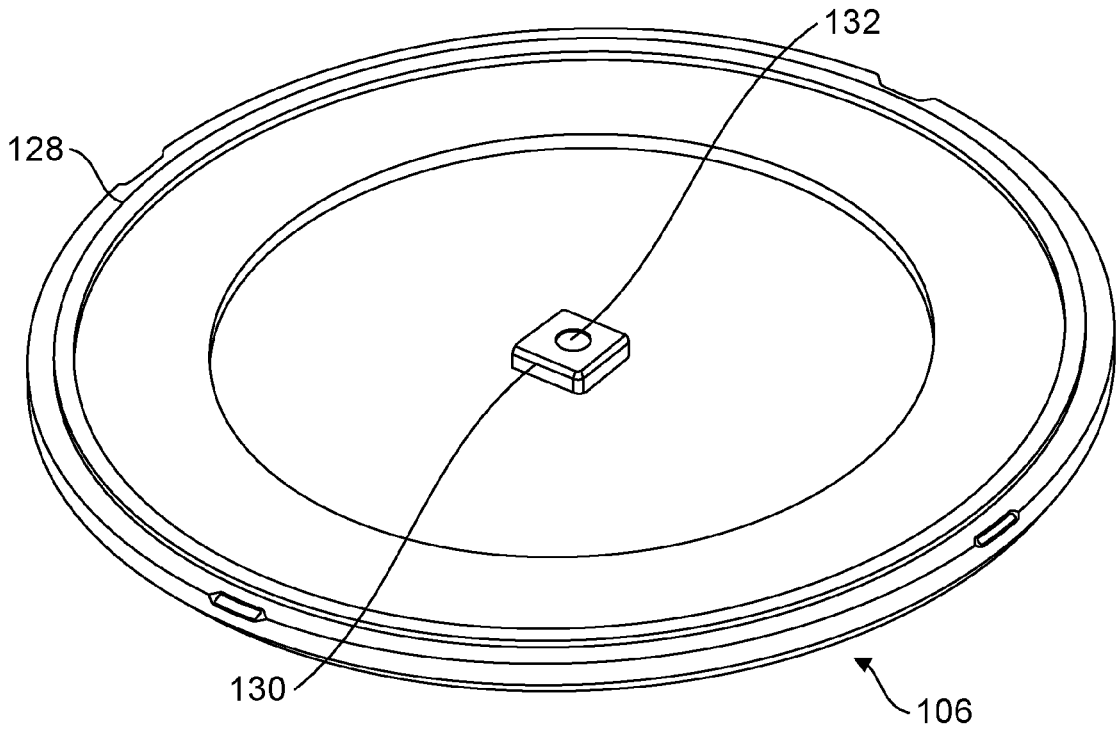
FIG. 4 is a depressed angle view (underside view) of the top half of the body of the first embodiment of the invention.

FIG. 4 is a depressed angle view (underside view) of the top half of the body of the overall invention.

Main body top (also circular body top) 106 has rail 128 which sits, as discussed previously, into the channel 126 and runs therein.

Rotational center platform 130 is important to proper operation of the device. The rotational center platform 130 fits into the center interface aperture 109 snugly, resulting in a mechanical engagement therewith. Without this aspect of the invention and without this special shape of the unibody multiarm resistance mechanism 108 to engage it, there would be no resistance to twisting motion. Thus, the rotational center platform 130 is dimensioned and configured to mechanically engage to the unibody multiarm resistance mechanism 108 at the center interface aperture 109, with the rotational center post 122 passing through the divot/aperture 132.

Divot 132 passes through the platform 130, and on the other side of the aperture 132 the assembly retention nut 104 is sitting in the platform 130, covered by the top pad 102.

Figure 5:
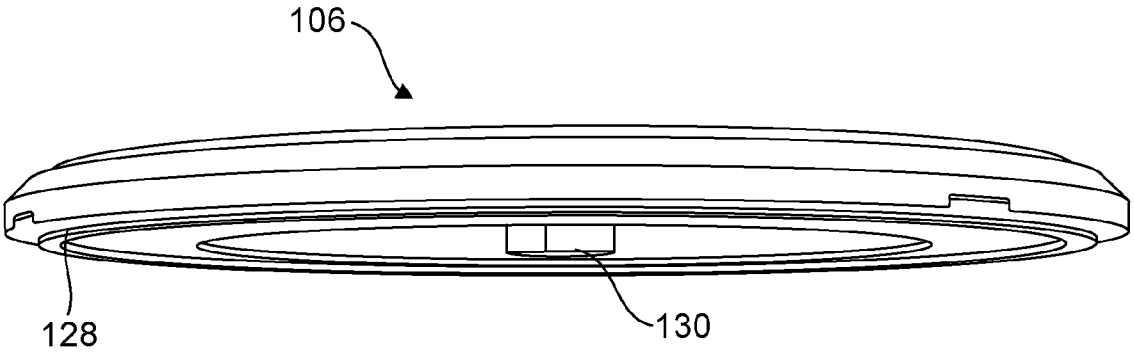
FIG. 5 is a front slightly depressed view of the top half of the body first embodiment of the invention.

FIG. 5 is a front slightly depressed view of the top half of the body. In this view the top half is shown properly oriented (see FIG. 1 for confirmation) and thus it is easier to see how the circular body top 106 and the rotational center platform 130 can cooperate with the unibody multiarm resistance mechanism 108 to provide the rotational resistance.

Figure 6:
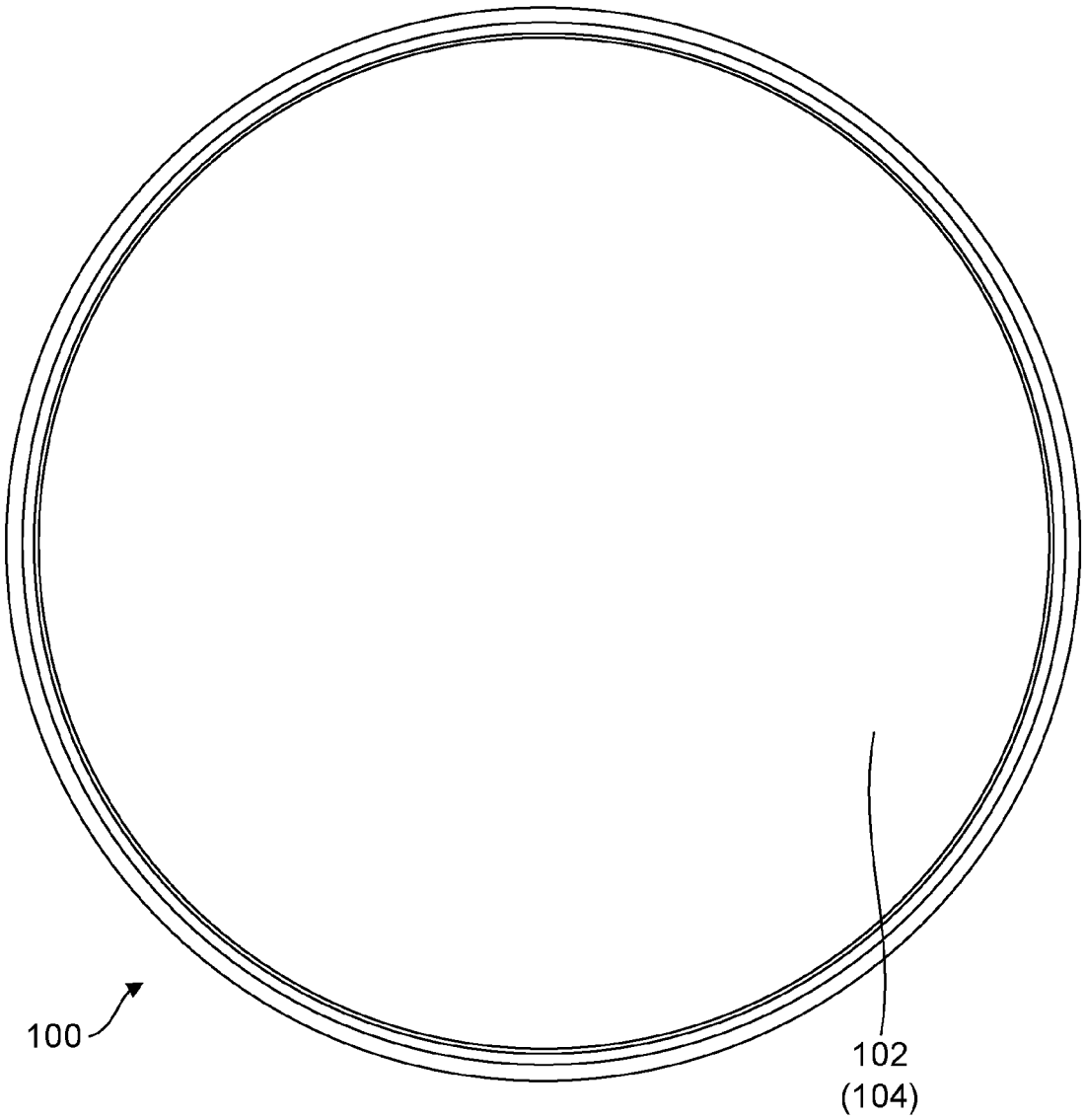
FIG. 6 is a top view of the first embodiment of the invention.

FIG. 6 is a top view of the invention. A user would see this view when directly overhead and preparing to use it in some exercises. The pivot board 100 is covered on the top (or partially covered) by top pad 102, which hides of course the assembly retention nut 104 and the main body top/circular body top 106.

Figure 7:
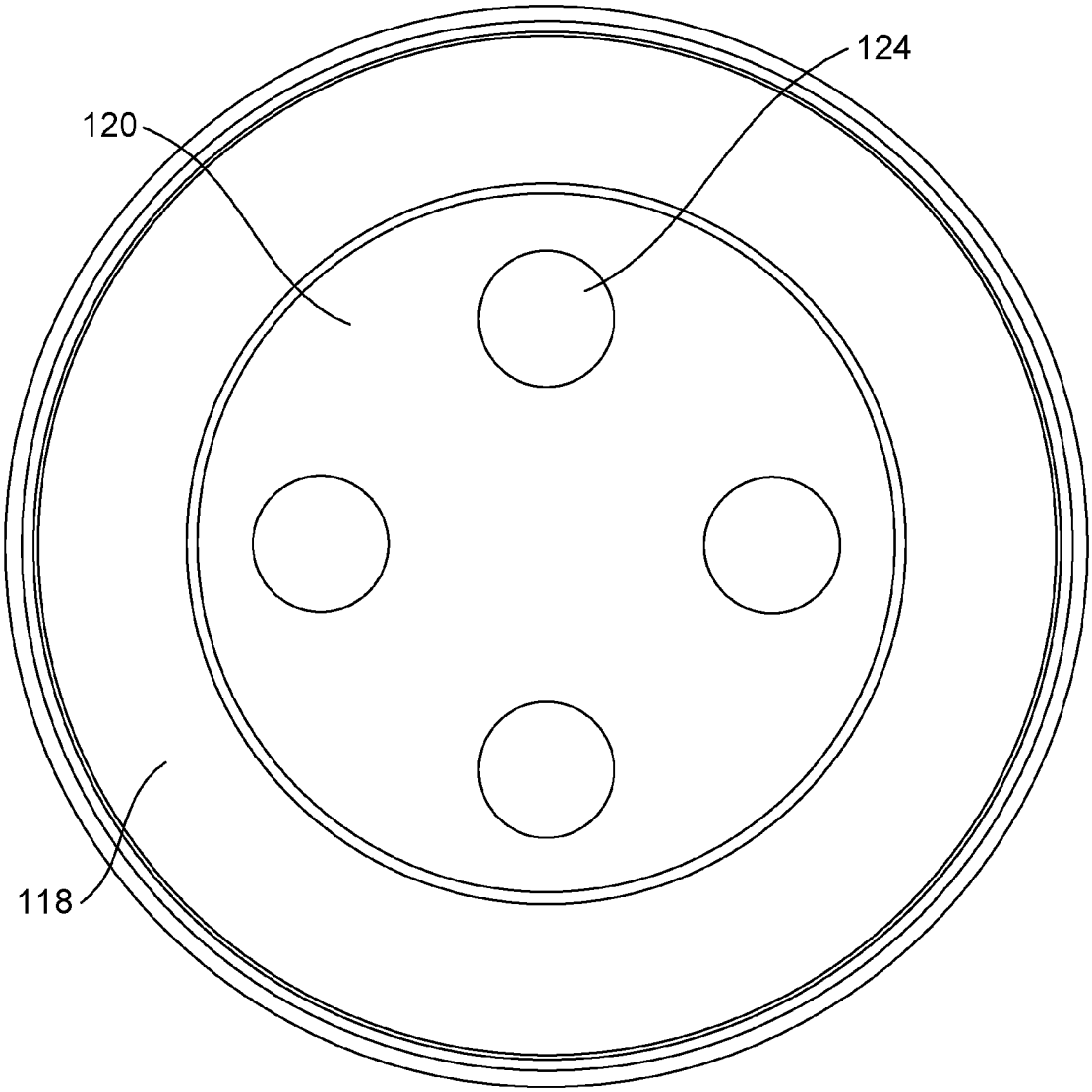
FIG. 7 is a bottom view of the first embodiment of the invention.

FIG. 7 is a bottom view of the invention.

In this embodiment the back 120 is smaller in diameter than the non-slip base 118, but in other embodiments this is not necessary.

Suction cup 124 (one of a plurality in this embodiment) may be seen from a bottom view.

Figure 8:
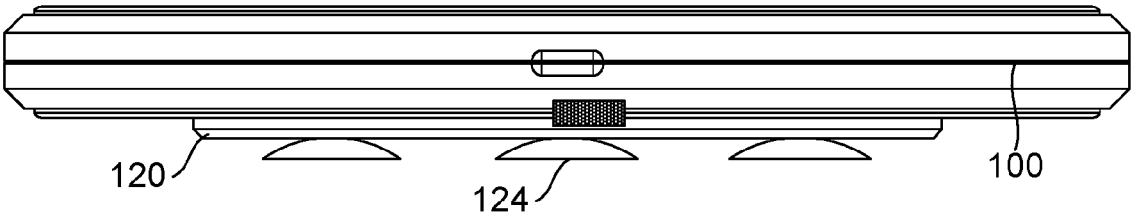
FIG. 8 is a side view (including left, right, front and back sides since all are identical) of the first embodiment of the invention.

FIG. 8 is a side view (including left, right, front and back sides since all are identical) of the invention. Pivot board 100 has the back 120 holding suction cups 124.

Figure 9:
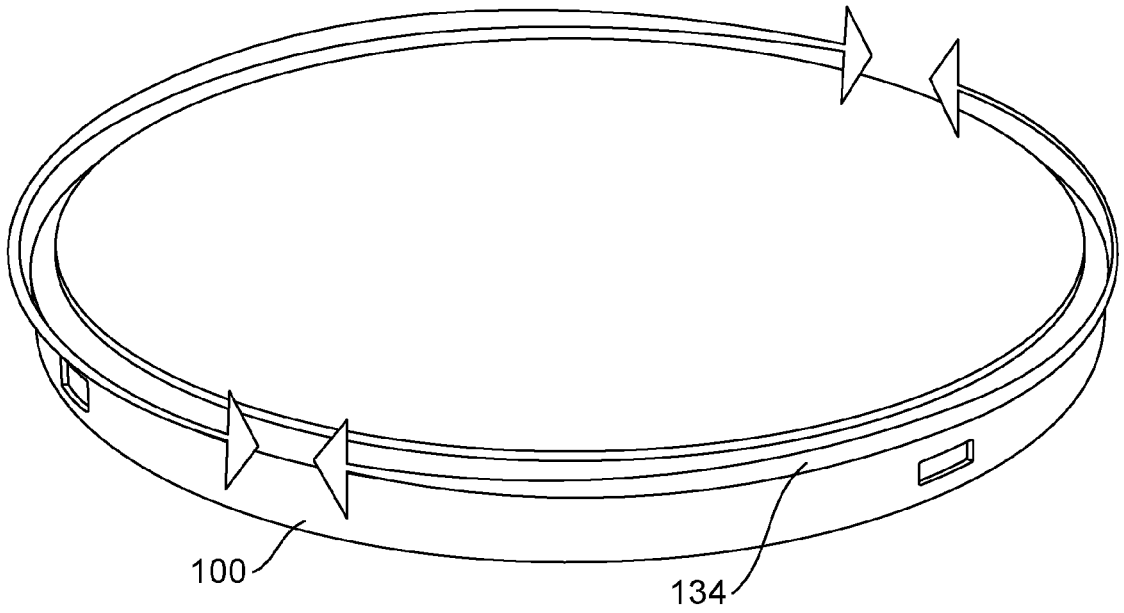
FIG. 9 is a perspective view of the complete first embodiment of the invention.

FIG. 9 is a perspective view of the complete invention 100. The upper surface of the disk has two degrees of rotational freedom 134. The use of the disk and the two degrees of freedom is now explained.

Example of Use One

Use of the device is quite simple, and so intuitive that many users can use it (not necessarily well) without instruction. With guidance, users can profit from the exercises which it allows.

In general, the device is used for rotational exercises rather than strength conditioning (note that there is overlap, since rotational exercises do develop strength in the newly activated muscle groups). A user could use two of the devices and place one hand, palm down, onto each device. The hand may be spread so as to get a good frictional grip with the topmost layer. The devices need not be on the floor: using the suction cups the devices might be located on a wall, which not only further extends the range of exercises possible but also is helpful for elderly or disabled users who might have difficulty exercising with their hands on the floor.

With their hands on the devices, the user may then twist their arms, activating muscles in different ways than standard exercises. The unibody multiarm resistance mechanism 108 will immediately exert a small resistance to the twist, but the user will normally be able to twist the device top further (with the base still secured to the wall (or floor) by the suction cups and thus not moving) and further, against building resistance.

Note that unlike prior art devices, the increase in torsional resistance will build gradually and evenly, aiding the user to maintain a proper exercise regimen. Eventually the user will not be able to twist further and they can gradually rotate their hands the other direction until the resistance is gone.

Example of Use Two

After completing one rotation of the first example of use, the user may maintain their hands on the flat top surface, just as they were for the first part. The user may then begin to rotate the top of the device in the other direction, that is, opposite the direction of the first part of the exercise.

After the user cannot twist further the other way, they can gradually rotate their hands back again until the resistance is gone, thus completing one full cycle of rotation.

A set can be carried out by repeating the combination of the two example exercises.

Note that the use is not limited to hands, the two example exercises discussed, any one posture, surface, body part, etc.

Figure 10:
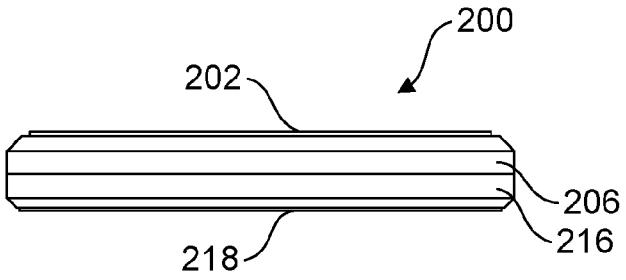
FIG. 10 is a side view (including left, right, front and back sides since all are identical) of the second embodiment of the invention.
Figure 11:
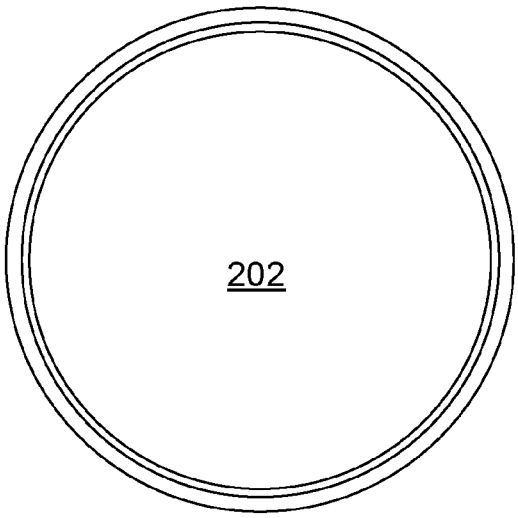
FIG. 11 is a top view of the second embodiment of the invention.

FIG. 10 is a side view (including left, right, front and back sides since all are identical) of the second embodiment of the invention. FIG. 11 is a top view of the second embodiment of the invention. Pivot board 200 has a Neoprene® (or similar material of a different brand) top pad 202 onto which users may place hands or feet or joints, limbs, etc. The Neoprene® material provides a solid grip and good traction, but also provides a degree of cushioning. Main body top 206 and main body bottom 216 are the two main sub-assemblies of the invention, within each there are connections to the complex (complex meaning, non-unitary and built of several parts, not meaning intricate or complicated) multi-arm resistance element.

Note that the top and bottom parts 206 and 216 are connected for imposed forces in translation (a push or weight) but are able to rotate freely in relation to one another in rotation.

Rubber non-slip base 218 provides traction with the floor or wall, or against a user's hand when the device is held in two hands.

Figure 12:
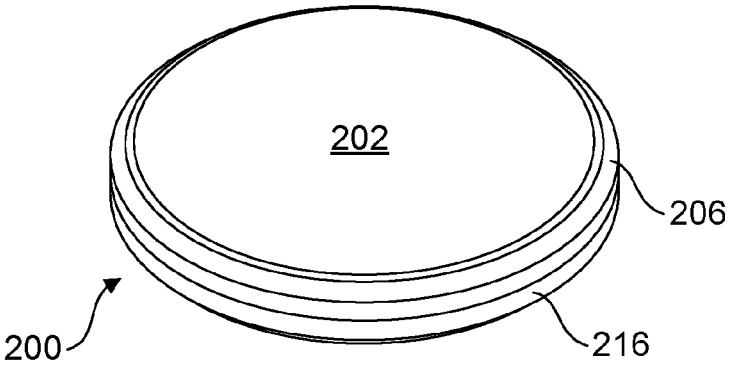
FIG. 12 is an elevational orthogonal view of the second embodiment of the invention.

FIG. 12 is an elevational orthogonal view of the second embodiment of the invention.

Pivot board 200 is largely seen to be the Neoprene brand top pad 202 although the main body top 206 is visible in this view. Main body bottom 216 is partially visible in FIG. 12 but is seen in FIG. 13.

Figure 13:
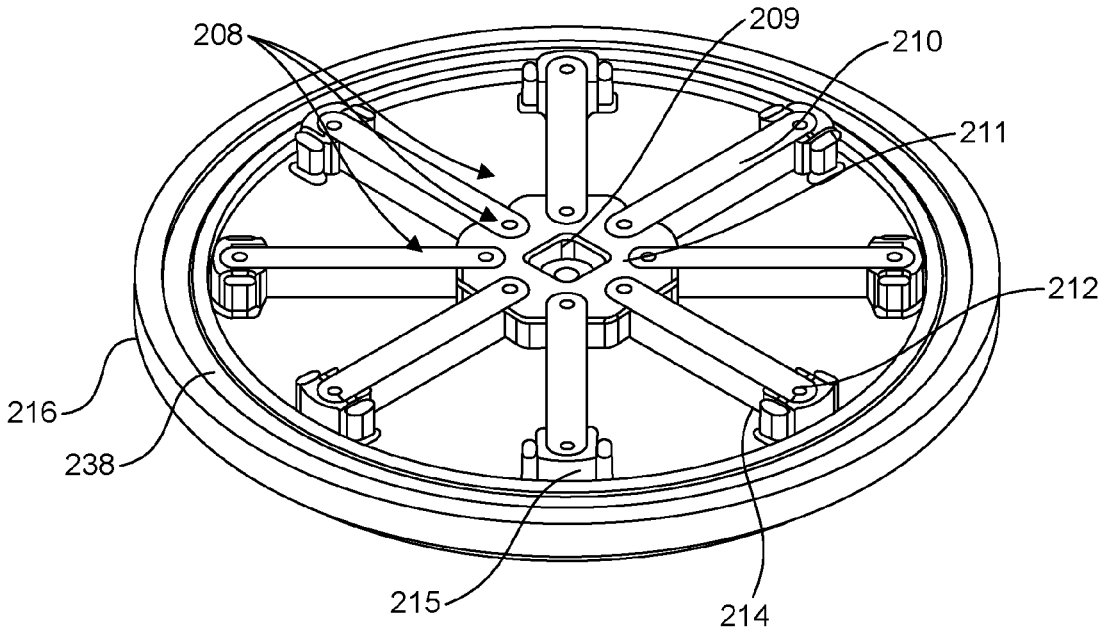
FIG. 13 is an elevational orthogonal view of the bottom half, assembled, of the second embodiment of the invention.

FIG. 13 is an elevational orthogonal view of the bottom half, assembled, of the second embodiment of the invention.

Figure 14:
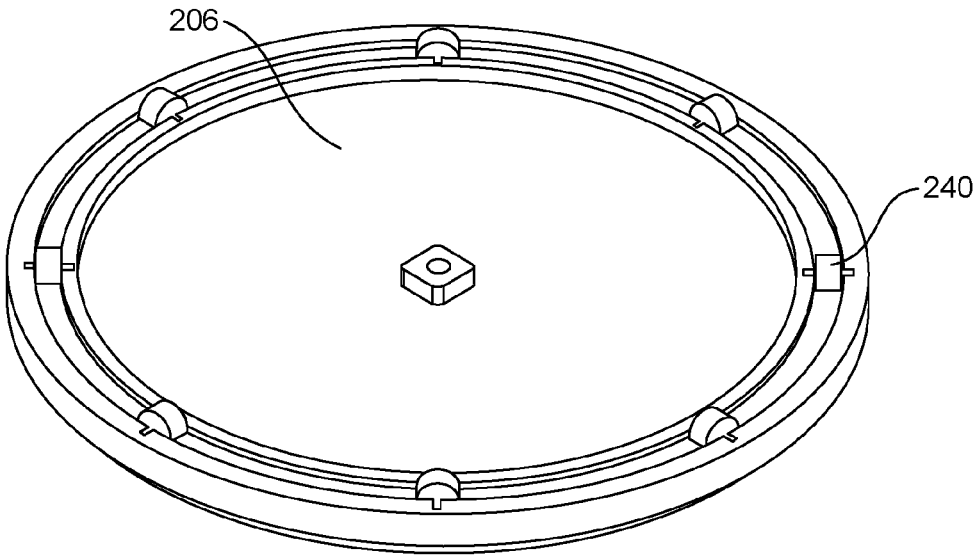
FIG. 14 is an elevational orthogonal view of the top half, assembled but inverted, of the second embodiment of the invention.

(FIG. 14 is a view of the top. If the two parts are imagined to be opened like a clam-shell and placed side-by-side, FIG. 13 and FIG. 14 would comprise a single view. However, they will be discussed separately here, for simplicity.)

Multi-arm resistance mechanism 208 may be seen to be largest structure within the bottom part 216, having an eight-armed configuration which radiates outward symmetrically in numerous different axes of reflection (8 different reflections) all about the center interface aperture 209. It has several different parts, falling into three categories: arms, brackets and the central carousel.

Carousel 211 has a respective pocket containing a proximal end of each respective arm 210, one pocket per arm proximal end. Each arm 210 has an aperture allowing attachment in the respective pocket of carousel 211. Note that center interface aperture 209, as in the previous embodiment, mechanically engages to the matching projection from the top body part 206, so that the rotation of the top part 206 relative to the bottom part 216 will rotate carousel 211.

Arm aperture 212 allows attachment if needed to a mounting post, but in this embodiment, mounting posts 214 are actually arranged in pairs and each arm's distal end near the circumference of the device is attached to an arm end bracket 215. The arm end bracket 215 in turn fits to not one but two mounting posts 214, one located on either side of the arm's distal end. (This may be seen more clearly in later drawings.)

Roller race 238 on the main body bottom part 216 allows the rollers 240 (See FIG. 14: FIG. 14 is an elevational orthogonal view of the top half, assembled but inverted, of the second embodiment of the invention) to move freely in the same two degrees of freedom previously discussed and depicted. However, the rollers (or one or more bearings) are trapped by attachment to the upper body part 206 and the roller race 238 and thus support weight and allow rotation but cannot allow the two body parts 206 and 216 to move in any other way relative to one another.

As discussed previously, one or more bearings 128 may be used instead of rollers 240. A single toroidal bearing, multiple spherical bearings, cylindrical bearings, etc. may all be used.

Figure 15:
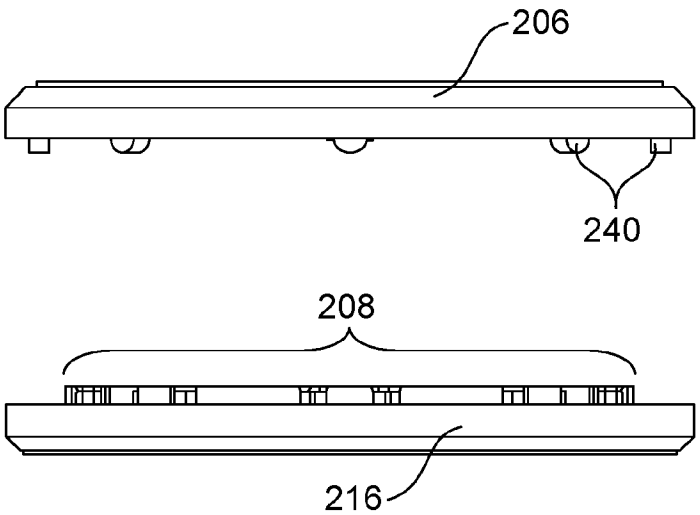
FIG. 15 is a side view of the top and bottom halves, assembled but apart, of the second embodiment of the invention.

FIG. 15 is a side view of the top and bottom halves, assembled but exploded apart, of the second embodiment of the invention, helping to show the important relationship of the multi-arm resistance mechanism 208 with the top and bottom parts 206 and 216, and the nature of the rollers 240.

As may be seen, main body top 206 is the top half of the "clam-shell" with main body bottom 216. In actuality, the user is not expected to open the device, unless they wish to replace the resistance arms 210 with stiffer or more flexible arms for their own personal reasons.

Multiarm resistance mechanism 208 is seen side on, as are the rollers/bearings 240, and it is instantly obvious that these two assemblies project between both top and bottom 206/216, thus allowing the mechanical engagement which provides both rotation and strength.

Figure 16:
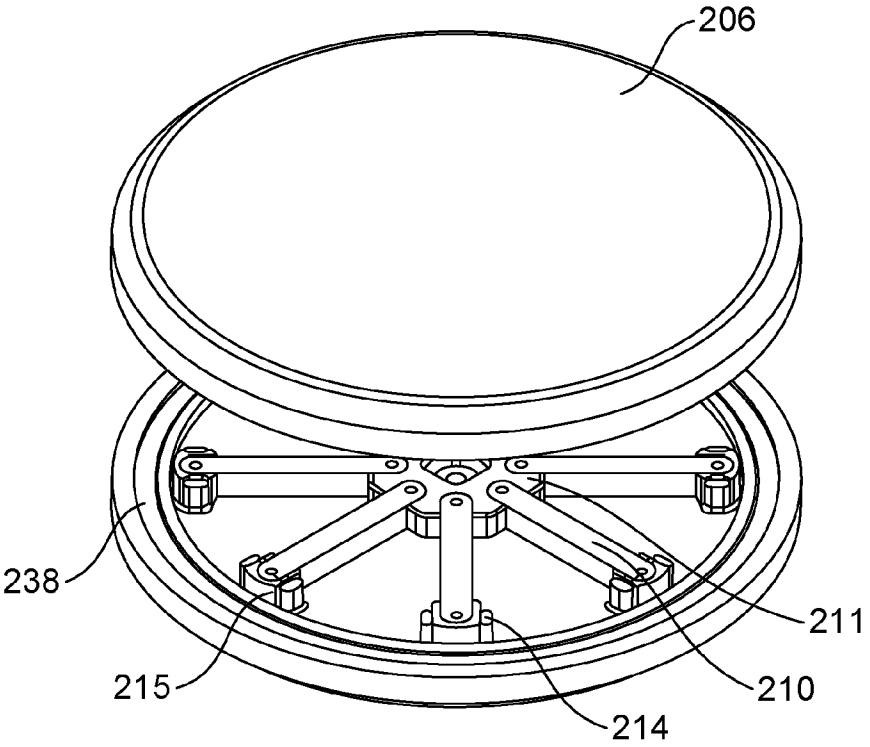
FIG. 16 is an elevational orthogonal view of the top and bottom halves, assembled but apart and thus semi-exploded view, of the second embodiment of the invention.

FIG. 16 is an elevational orthogonal view of the top and bottom halves, assembled but apart and thus semi-exploded view, of the second embodiment of the invention.

Main body top 206 is seen above the multiarm assembly (only five arms visible), with carousel 211 partially visible in the center. Arm 210 radiates outward to mounting posts 214 but it is arm end bracket 215 which actually engages to the mounting post pairs.

Note that roller race/bearing race 238 (126) is once again visible on bottom half 216.

Figure 17:
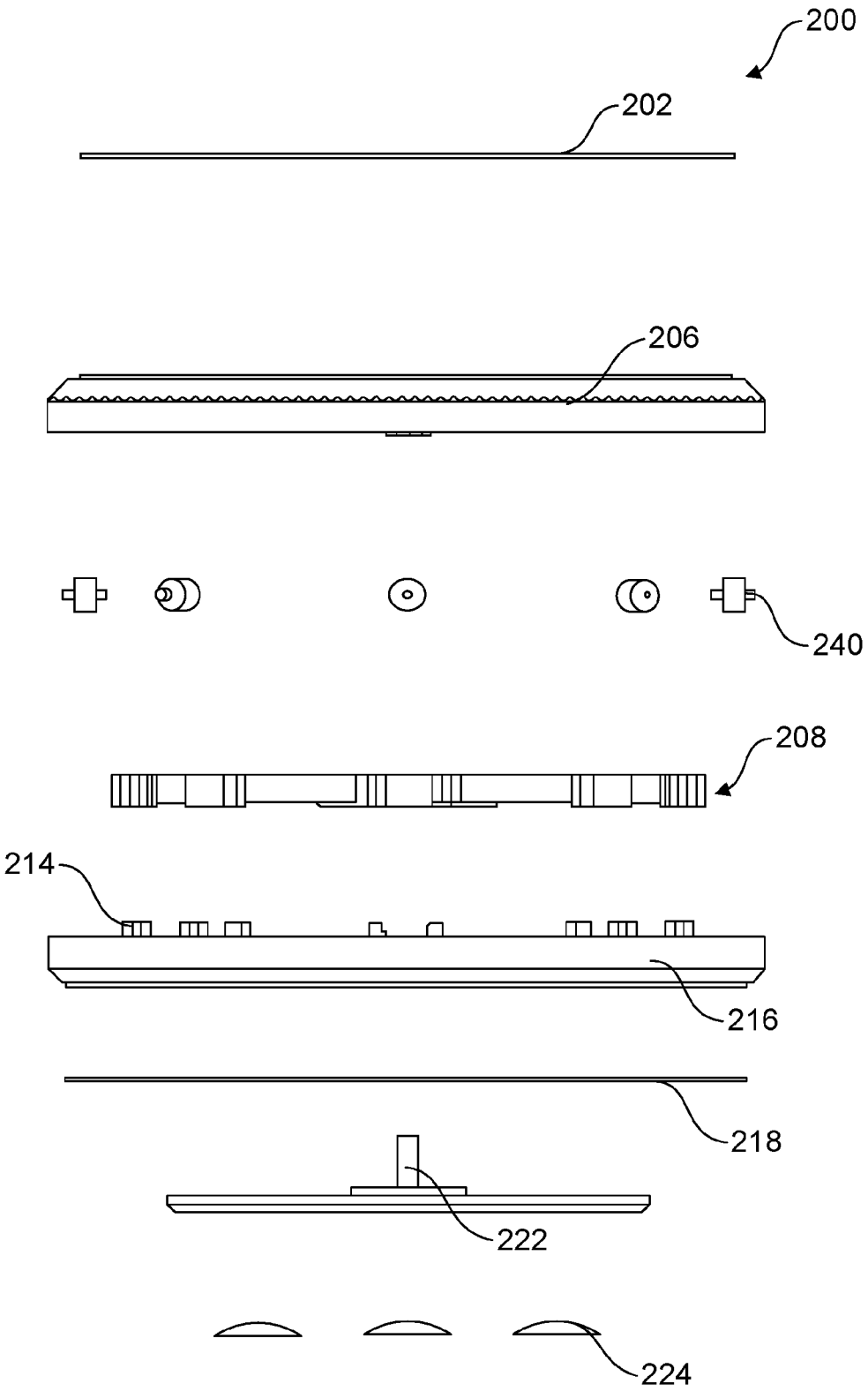
FIG. 17 is a side and exploded view of the invention.
Figure 18:
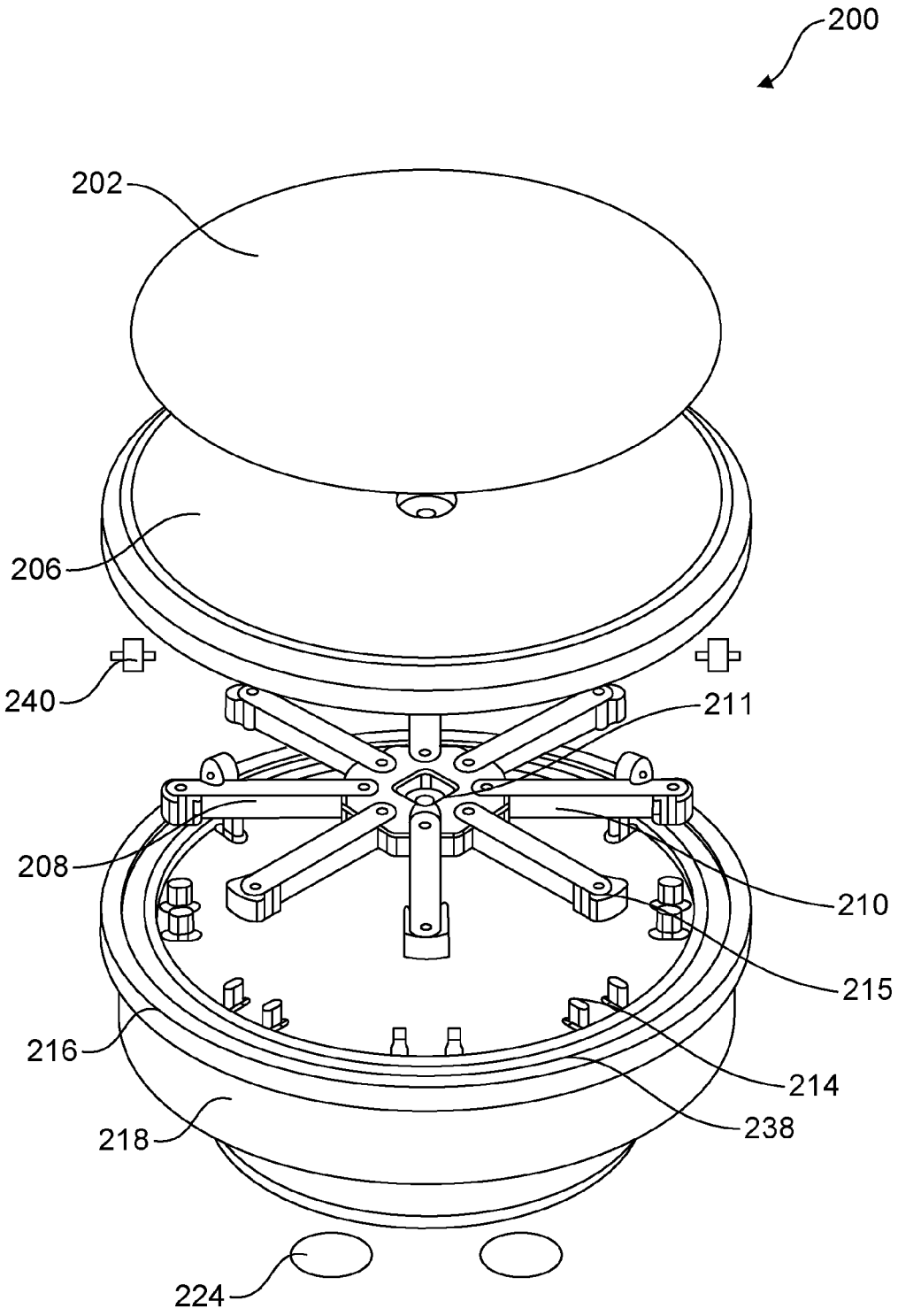
FIG. 18 is an elevational side (and exploded) view of the second embodiment of the invention.

FIG. 17 is a side and exploded view of the invention. FIG. 18 is an elevational side (and exploded) view of the second embodiment of the invention. Seeing the "layers" is very helpful to comprehending the construction of the device.

Pivot board 200 has as the top-most layer polymer top pad 202, sitting attached by adhesives to main body top 206. Rollers/bearings 240 are attached by small axes to small cavities in the bottom of the main body top 206, but in these exploded views the rollers/bearings are shown separately.

Multiarm resistance mechanism 208 is the next layer down, including its various components: the center interface aperture 209, the arms 210 radiating from the carousel 211, and the either arm end brackets 215 (only seven visible in FIG. 18).

Mounting posts 214 and arm end brackets 215 are dimensioned and configured to fit together and hold securely despite the forces and torsions applied by users.

The mounting posts 214 project upward from the main body bottom 216, which has underneath the rubber non-slip base 218.

As discussed in reference to the first embodiment, the rotational center post 222 appears much like a central axis of the entire device, though in function it is a mounting post projecting through the various "layers" to the top part 206 and holding the entire device sandwiched together. On the bottom of the non-slip base 218 and/or the disk of the central mounting pot 222, there may be attached and detached as users like a plurality of suction cups 224.

Example of Use Three

The user may place the device on a floor surface and then place a significant load on it. For example, a user may rest one or both feet on the device, then increase muscle tension and the forces imposed on the device. Due to the usage of rollers, numerous mounting posts and a large number of resistance elements, the device can easily withstand the loads imposed as the user then twists their leg or even both legs and torso, acting against the increasing resistance of the arms, which are the elastic elements providing resistance.

Numerous other exercises divided into various groups of body parts, different motions, varying postures and so forth may be carried out with the durable, flexible and easily usable device of the invention This disclosure is provided to render practicable the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. An exercise device comprising:

a circular body top and a circular body bottom, the circular body bottom having a plurality of posts projecting upward, the circular body top having a rotational center platform projecting downward;

a non-slip base, the non-slip base disposed beneath the circular body bottom;

a back, the back disposed beneath the non-slip base;

a multi-arm resistance mechanism, the multi-arm resistance mechanism having a central carousel, the central carousel having a center interface aperture, the multi-arm resistance mechanism having a plurality of arms projecting from the central carousel, each arm having at least one arm end bracket, each arm end bracket dimensioned and configured to accept at least one post of the plurality of posts, whereby the plurality of arms are secured to the circular body bottom;

the plurality of arms made of a resilient material;

the center interface aperture dimensioned and configured to mechanically engage to the rotational center platform, whereby the multi-arm resistance mechanism is secured to the circular body top;

a center post projecting upward from a center of the non-slip base through the center interface aperture in the center of the multi-arm resistance mechanism, and into a center of the rotational center platform of the circular body top;

whereby the circular body top is configured to rotate in relation to the circular body bottom, but the plurality of arms of the multi-arm resistance mechanism provide resistance to urge the circular body top against rotation.

2. The exercise device of claim 1, further comprising:

a neoprene top panel sitting atop the circular body top.

3. The exercise device of claim 2, further comprising:

a roller race about a circumference of the circular body bottom dimensioned and configured to mechanically engage to a plurality of rollers attached to the circular body top, so that the rollers are configured to ride in the roller race.

4. The exercise device of claim 2, further comprising:

a bearing race in the circular body bottom dimensioned and configured to accept at least one bearing and to mechanically engage thereto, so that the at least one bearing is configured to ride in the bearing race.

5. The exercise device of claim 3, further comprising:

a plurality of suction cups disposed upon a bottom of the back.

* * * * *